United States Patent [19]

Baker et al.

[11] 4,403,435

[45] Sep. 13, 1983

[54] RELEASE AND ALIGNMENT MECHANISM FOR JET-PROPELLED PROJECTILES

[75] Inventors: Alan C. Baker, Huntington Beach; Nathan N. Shiovitz, Anaheim; George E. Whiting, Santa Ana, all of Calif.

[73] Assignee: Brunswick Corporation, Skokie, Ill.

[21] Appl. No.: 250,427

[22] Filed: Apr. 2, 1981

[51] Int. Cl.[3] ..... F41C 27/06

[52] U.S. Cl. ..... 42/1 F; 89/1.808; 102/483

[58] Field of Search ..... 42/1 F; 89/1.808; 102/379, 380, 374, 381, 483, 488, 378

[56] References Cited

U.S. PATENT DOCUMENTS

| | | | |
|---|---|---|---|
| 932,214 | 8/1909 | Wieser | 42/1 F X |
| 1,003,079 | 9/1911 | Wieser | 42/1 F X |
| 2,939,449 | 6/1960 | Kortick | 42/1 F X |
| 3,165,836 | 1/1965 | Magardo | 33/257 |
| 3,245,350 | 4/1965 | Kelly | 42/1 F X |
| 3,332,162 | 7/1967 | Martwick et al. | 42/1 F |
| 3,442,173 | 5/1969 | Muller | 42/1 F X |
| 3,554,078 | 1/1971 | Horvath | 89/1.808 |
| 3,724,781 | 4/1973 | Makow | 102/483 X |

*Primary Examiner*—David H. Brown

*Attorney, Agent, or Firm*—William G. Lawler, Jr.; John R. Hoffman

[57] ABSTRACT

A projectile release mechanism is disclosed for facilitating launching a jet-propelled projectile in the form of a spherical spin-stabilized missile. The mechanism includes a nozzle extending from the projectile, including fusible joint means for heating by high-temperature exhaust gases expelled by the projectile to release the projectile. A projectile support includes an open-ended receptacle generally coaxial with the nozzle for receiving the nozzle and thereby supporting the projectile. Forwardly and rearwardly facing shoulders on the support engage complementary rearwardly and forwardly facing shoulders on the nozzle for retaining the nozzle in the receptacle and permitting fore and aft sections of the nozzle to move out of the open ends of the receptacle on fusing and separation of the fusible joint means. The forwardly facing shoulder on the support means and the rearwardly facing shoulder on the nozzle comprise conical sections generally concentric with the axis of the nozzle. Springs are operatively associated with the nozzle and are effective to maintain the shoulder portions in engagement until complete separation of the fusible joint, thereby accommodating any thermal expansion of the nozzle.

22 Claims, 6 Drawing Figures

RELEASE AND ALIGNMENT MECHANISM FOR JET-PROPELLED PROJECTILES

BACKGROUND OF THE INVENTION

This invention relates to a projectile release mechanism for facilitating launching of a jet-propelled projectile, particularly a spherical spin-stabilized missile, and for insuring proper alignment of the missile with its spin axis during initial separation.

It has become increasingly important to eliminate the features associated with a ballistic trajectory ordinarily followed by rockets and other jet-propelled projectiles, by forming the projectiles as spherical spin-stabilized missiles. The spherical missile spins about an axis upwardly inclined relative to the intended straight line path of flight and aligned with the thrust axis of the propulsion jet of the missile. The missile is released following ignition or activation of the jet propellant within the missile. The propulsion is effected by the reaction of the exhaust jet of, for example, a rocket motor housed within the spherical missile shell.

Often such spherical spin-stabilized missiles are provided in conjunction with attachments secured to the front end of an assault weapon such as a rifle.

Such spin-stabilized spherical jet-propelled missiles experience difficulties in remaining stabilized during attainment of desired rotational speed and in coordinating the spinning and release of the missile. Release of the missile prior to attainment of adequate rotational speed can result in unstable flight. Delay of release after attainment of adequate rotational speed can result in a loss of propulsive range.

Consequently, attempts have been made to provide means for temporarily restraining and automatically releasing a spin-stabilized jet-propelled spherical missile during spinup. For instance, in U.S. Pat. No. 3,245,350 to J. A. Kelly, dated Apr. 12, 1966, a mechanical release is provided between a rifle barrel and a spin-stabilized spherical missile in order to selectively release the missile. However, precise automatic release is not afforded. More specifically, U.S. Pat. No. 3,554,078 to Joseph S. Horvath, dated Jan. 12, 1971, provides a fusible link for temporarily restraining and automatically releasing a spherical spin-stabilized missile during spinup. Release of the spherical rocket missile from its rotary supporting means is effected by causing hot missile rocket exhaust gas to weaken by heating or to heat and soften or melt a separate fusible link member which, prior to weakening by softening or melting, secures the missile to the rotary support means. In this patent, the separate fusible link member is of the nature of a brazing alloy serving as one part of a nozzle assembly to secure the rocket to the rotary support means. The fusible link member is brazed between two separate fore and aft nozzle portions which are permanently secured to the missile and to the support means, respectively, as by threaded engagements.

In copending application Ser. No. 206,370, filed Nov. 13, 1980, to Alan Clark Baker and Joe Thomas Zinn, Jr., entitled "Release Apparatus For Jet-Propelled Projectiles," and assigned to the assignee of the present invention, a new and improved nozzle assembly is disclosed. The nozzle assembly includes a unitary nozzle member having fusible joint means formed integrally therewith, between the missile and the rotary support means, thereby eliminating the assembly and brazing operations of prior devices as shown in the Horvath patent, and thereby considerably reducing manufacturing costs and improving accuracy. However, in this application the fore and aft sections of the unitary nozzle, forwardly and rearwardly of the fusible joint means, are permanently fixed to the missile and to the support means, respectively, as by threaded engagements.

The present invention is directed to providing a further new and improved nozzle assembly in which the projectile support means includes open-ended receptacle means out of which the fore and aft sections of the nozzle can move on fusing and separation of the fusible joint means. The invention also includes novel means for accommodating thermal expansion of the nozzle member, particularly at the fusible joint means.

SUMMARY OF THE INVENTION

An object, therefore, of the present invention is to provide a new and improved projectile release mechanism for facilitating launching a jet-propelled projectile.

Another object of the invention is to provide a new and improved projectile release mechanism which includes a novel construction providing separation of fore and aft sections of the nozzle member on opposite sides of the fusible joint or separation means.

A further object of the invention is to provide novel retaining means for the nozzle member to insure proper alignment of the missile with its spin axis during initial separation of the separation means.

Still a further object of the invention is to provide means for accommodating any thermal expansion of the nozzle member, particularly in the area of the fusible joint means.

In the exemplary embodiment of the invention, the release mechanism includes a nozzle member extending from the projectile, including fusible joint means for heating by high-temperature exhaust gases expelled by the projectile to release the projectile. The nozzle extends rearwardly of the projectile into rotary support means for rotation of the projectile about a spin axis coaxial with the nozzle secured between the projectile and the rotary support means. The support means includes an open-ended receptacle generally coaxial with the axis of the nozzle. Means is provided for retaining the nozzle in the receptacle and permitting fore and aft sections of the nozzle to move out of the open ends of the receptacle on fusing and separation of the fusible joint means.

In the preferred embodiment of the invention, the retaining means includes forwardly and rearwardly facing shoulder portions on the support means, forward and rearward of the fusible joint means, and complementarily engageable shoulder portions on the nozzle. The forwardly facing shoulder portion on the support means comprises a forwardly opening conical section generally concentric with the axis of the nozzle and engageable with a complementary conical shoulder portion on the nozzle.

Biasing means is provided operatively associated with the nozzle and effective to maintain the shoulder portions of the nozzle member in engagement with the shoulder portions of the support means until complete separation of the fusible joint means. This accommodates any thermal expansion of the nozzle, particularly in the area of the fusible joint means. In the exemplary embodiment of the invention, the biasing means comprises a plurality of spring members equally spaced about and concentric with the axis of the nozzle. The spring members bias a rear, forwardly facing flange on the nozzle into engagement with the rearwardly facing shoulder portion on the support means. It should be understood that the invention contemplates employing a biasing means directly between the nozzle and the support means.

Other objects, features and advantages of the invention will be apparent from the following detailed description taken in conjunction with the accompanying drawings.

DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE INVENTION

Figure 1:
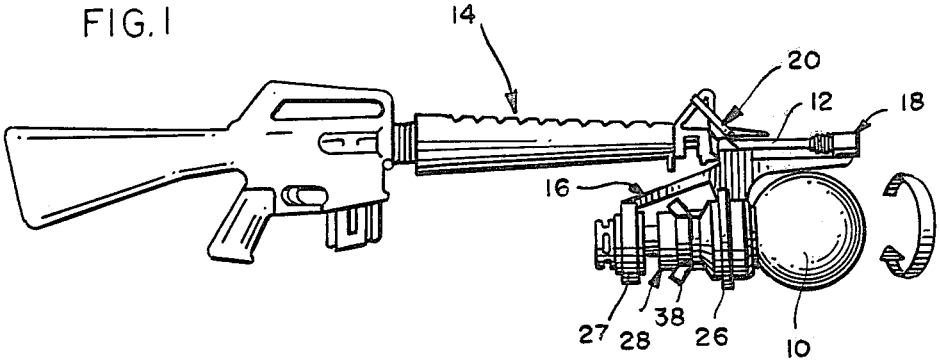
FIG. 1 is an elevational view of a spherical spin-stabilized missile mounted on the barrel of a rifle and incorporating the release mechanism of the present invention.

Referring to the drawings in greater detail, and first to FIG. 1, a spherical spin-stabilized jet-propelled missile 10 is shown mounted to the front of a barrel 12 of an assault weapon such as a rifle, generally designated 14. The rifle shown is a standard M-16A1 military rifle.

Figure 2:
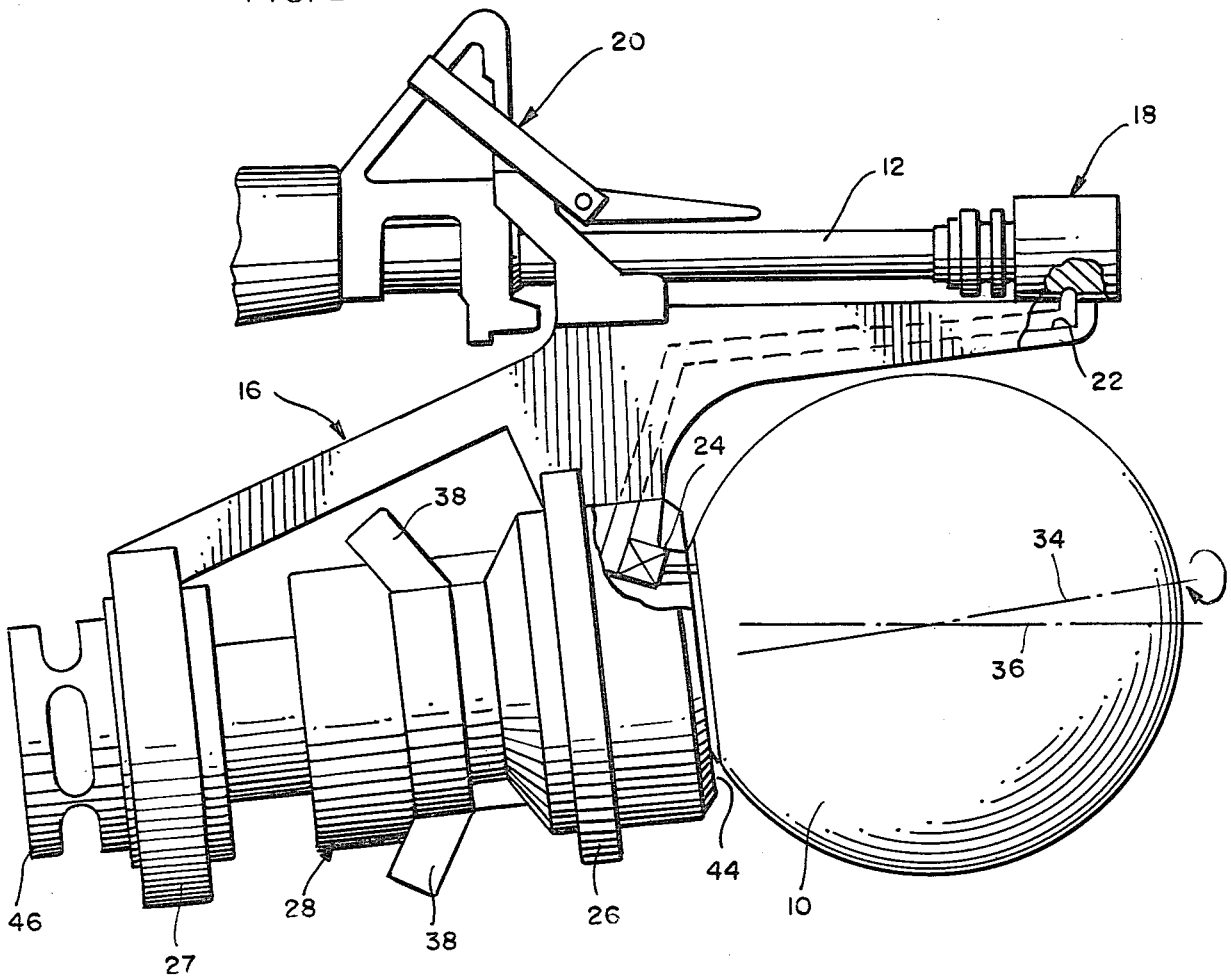
FIG. 2 is a fragmented side elevational view, on an enlarged scale, of the spherical missile mounted on the front end of the rifle barrel.
Figure 3:
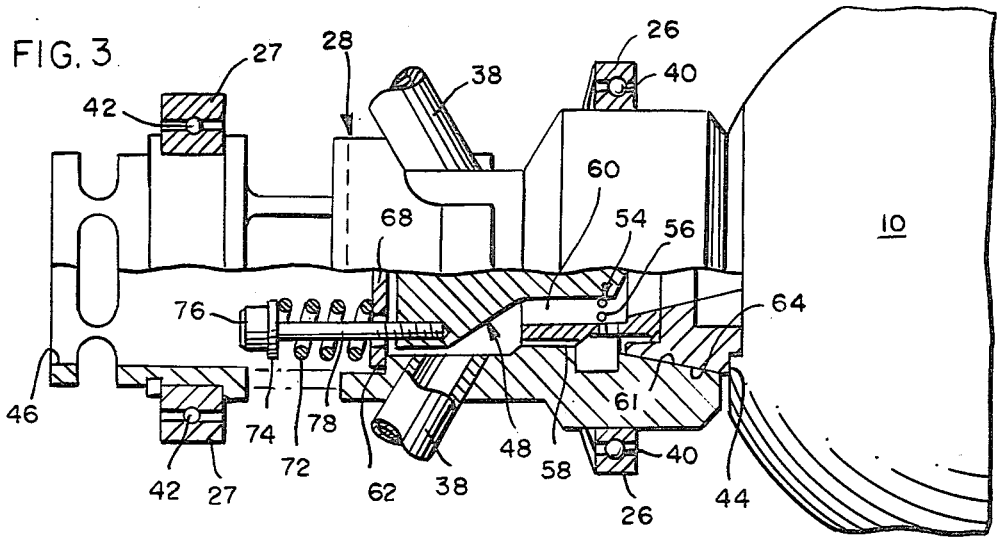
FIG. 3 is a fragmented side elevational view, partially in section, showing the interior components of the release mechanism of the present invention, prior to separation.

As shown in FIG. 1 and in the enlarged view of FIG. 2, a missile support means, generally designated 16, includes a front upper bracket portion, generally designated 18, and a rear upper latch portion, generally designated 20. Bracket portion 18 is positioned on the barrel 12 whereby part of the gas emanating from the barrel is channeled through a passageway 22 (FIG. 2) to a pneumatically actuated pin assembly 24 which is effective to strike a primer on missile 10 to ignite the rocket propellant therein as is known in the art. Latch 20 simply is provided to lock support means 16 onto the rifle barrel.

Support means 16 also includes turbine support portions 26 and 27, and rotary means, generally designated 28. Rotary means 28 is disposed on an axis 34 upwardly inclined relative to an extended straight line path of flight 36 generally parallel to the axis of rifle barrel 12. As is known in the art, axis 34 is the spin axis of missile 10: i.e., the motor thrust of the missile rocket motor. Axis 36 defines the line of flight of the missile and is the forward velocity component thereof.

Referring to FIGS. 3–6, rotary means 28 includes a plurality of turbine nozzles 38. In assembly, the rotary means is rotatable within turbine support portions 26 and 27 by bearing means 40 and 42, respectively. The rotary means forms an open-ended receptacle having a forward open end 44 and a rear open end 46. Thus, the receptacle is generally coaxial with spin axis 34 (FIG. 2).

A nozzle assembly, generally designated 48, includes a fore section 50 and an aft section 52 (FIGS. 4–6) joined by an integral fusible joint means, generally designated 54. The fusible joint means is similar to that shown in the afore-mentioned application and is disposed for heating by high-temperature exhaust gases expelled by missile 10 to release the missile from support means 16 and particularly rotary means 28. More particularly, a plurality of passages 56 extend through the nozzle for conducting the exhaust gas through fusible joint means 54, through internal passages 58, and out through turbine nozzles 38. The remainder of the gases from the rocket motor within missile 10 pass axially through the fore section of the nozzle, through an internal passage 60 and out through turbine nozzles 38.

Figure 4:
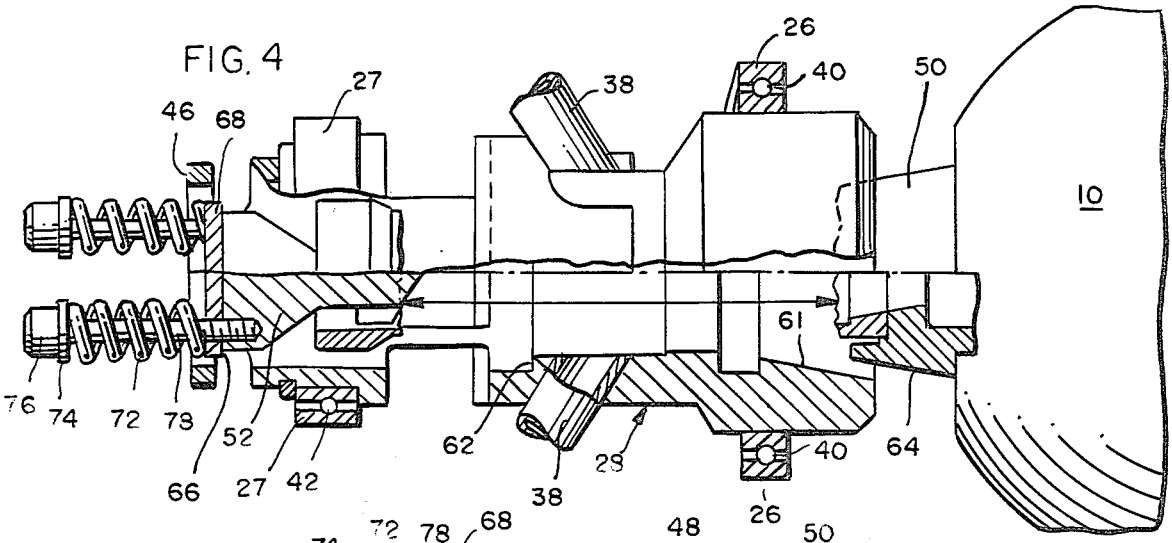
FIG. 4 is a view similar to that of FIG. 3, showing the components after fusing and separation of the fusible joint means.
Figure 5:
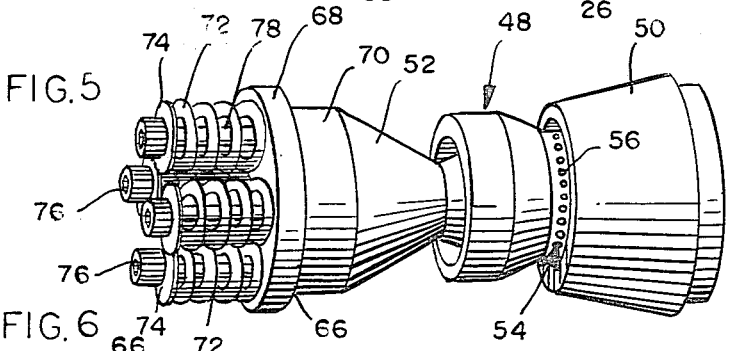
FIG. 5 is a perspective view of the nozzle assembly of the present invention, prior to separation.
Figure 6:
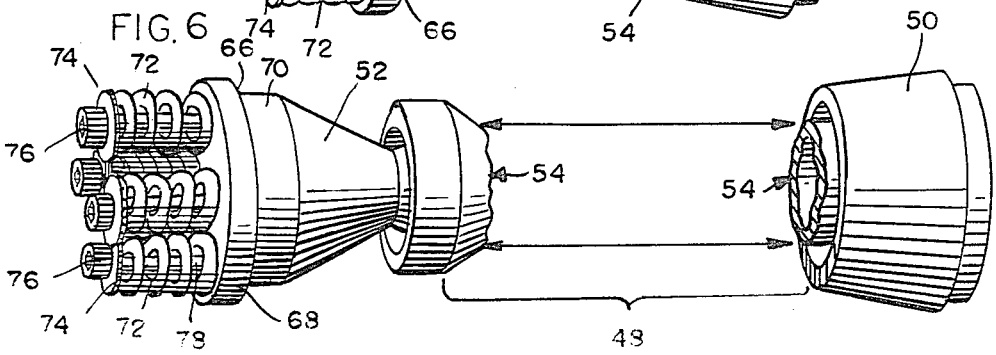
FIG. 6 is a perspective view similar to that of FIG. 5, showing the nozzle assembly after fusing and separation of the fusible joint means.

Thus, it can be seen best in FIGS. 4 and 6 that the fore and aft sections, 50 and 52, respectively, can move out of the front and rear ends 44 and 46, respectively, of the open-ended receptacle defined by rotary means 28, on fusing and separation of fusible joint means 54.

Means is provided for retaining the nozzle in the receptacle defined by the rotary means and for permitting the fore and aft sections of the nozzle to separate and move out of the front and rear ends of the receptacle on separation at the fusible joint means. More particularly, a forwardly facing shoulder portion 61 and a rearwardly facing shoulder portion 62 are provided on the rotary support means 28. The forwardly facing shoulder portion comprises a forwardly opening conical section generally concentric with the axis of the nozzle assembly and terminating forwardly at the open end 44 of the receptacle. The nozzle assembly is provided with a complementary rearwardly facing shoulder portion 64 and a forwardly facing shoulder portion 66 for engaging the forwardly and rearwardly facing shoulder portions 61 and 62, respectively. The rearwardly facing shoulder portion 64 of the nozzle assembly has a conical conformation complementary to the conical section 61 on the interior of the rotary support means. These complementarily engageable conical sections greatly facilitate proper alignment of the missile with spin axis 34 during initial separation of the nozzle assembly at fusible joint means 54 because of its precise alignment prior to separation.

Biasing means is provided operatively associated with the nozzle assembly and effective to maintain the conical shoulder portions 61, 64 in engagement until complete separation of the fusible joint means, thereby accommodating any thermal expansion of the nozzle, particularly in the area of the fusible joint means. More particularly, a ring-like flange 68 is slidably mounted on a flat, circular land portion 70 of the aft section 52 of the nozzle assembly. This ring defines the forwardly facing shoulder portion 66 which engages the rearwardly facing shoulder portion 62 to retain the nozzle assembly in the receptacle defined by rotary support means 28. A plurality of coil springs 72 are equally spaced about and concentric with the axis of the nozzle assembly. This insures uniform pressure on the ring flange 68. Each spring is sandwiched between the ring flange and a washer 74 seated forwardly of a head portion 76 of a bolt or shaft 78. Shafts 78 protrude through the ring flange and are secured to the rear side of the aft section 52 of the nozzle assembly. Thus, it can be seen that the ring flange is biased by the springs against the rearwardly facing shoulder portion 62 of the rotary support means. With the ring flange so seated, the springs are effective to bias the entire nozzle assembly rearwardly of the open-ended receptacle defined by the rotary support means. This maintains the conical shoulder portion 64 on the fore section 50 of the nozzle assembly seated on the complementary conical shoulder portion 61 on the interior of the rotary support means. During heating of the nozzle assembly, particularly in the area of fusible joint means 54, by the very high temperature gases emanating from the missile rocket motor, the material of the nozzle assembly, using metal, expands due to the high temperatures. With prior art release mechanisms, this expansion not only tended to cause binding within the mechanism, but proper alignment of the nozzle assembly and missile was inhibited. It can be seen that with the present invention, the nozzle assembly is preloaded by springs 72 and the springs are effective to accommodate any thermal expansion by biasing the aft section of the nozzle assembly rearwardly and constantly maintaining the conical section of the nozzle assembly in proper aligned engagement until complete separation of the fusible joint means. It should be understood that the invention contemplates the use of a single spring or other equivalent biasing means for preloading the nozzle assembly.

It will be understood that the invention may be embodied in other specific forms without departing from the spirit or central characteristics thereof. The present examples and embodiments, therefor, are to be considered in all respects as illustrative and not restrictive, and the invention is not to be limited to the details given herein.

We claim:

1. A projectile release mechanism for facilitating launching a jet-propelled projectile, comprising:

a nozzle extending from said projectile, including fusible joint means for heating by high-temperature exhaust gases expelled by said projectile to release the projectile;

a projectile support means, including open-ended receptacle means generally coaxial with said nozzle for receiving the nozzle and thereby supporting said projectile; and means for retaining the nozzle in said receptacle means and permitting fore and aft sections of said nozzle to move out of the open ends of said receptacle means on fusing and separation of said fusible joint means.

2. The projectile release mechanism of claim 1, further including biasing means operatively associated with said nozzle and effective to maintain said retaining means operative until complete separation of said fusible joint means, thereby accommodating any thermal expansion of the nozzle.

3. The projectile release mechanism of claim 2 wherein said biasing means comprises a plurality of spring members equally spaced about and concentric with the axis of said nozzle.

4. The projectile release mechanism of claim 1 wherein said retaining means includes forwardly and rearwardly facing shoulder portions on said support means, forward and rearward of said fusible joint means, and complementarily engageable shoulder portions on said nozzle.

5. The projectile release mechanism of claim 4 wherein said forwardly facing shoulder portion on said support means is outwardly tapered relative to the axis of said nozzle and engageable with a complementarily inwardly tapered shoulder portion on said nozzle.

6. The projectile release mechanism of claim 4 wherein said forwardly facing shoulder portion on said support means comprises a forwardly opening conical section generally concentric with the axis of said nozzle and engageable with a complementary conical shoulder portion on said nozzle.

7. The projectile release mechanism of claim 4, further including biasing means operatively associated with said nozzle and effective to maintain the shoulder portions of said nozzle member in engagement with the shoulder portions of said support means until complete separation of said fusible joint means, thereby accommodating any thermal expansion of the nozzle.

8. The projectile release mechanism of claim 7 wherein said forwardly facing shoulder portion on said support means is outwardly tapered relative to the axis of said nozzle and engageable with a complementarily inwardly tapered shoulder portion on said nozzle.

9. The projectile release mechanism of claim 7 wherein said forwardly facing shoulder portion on said support means comprises a forwardly opening conical section generally concentric with the axis of said nozzle and engageable with a complementary conical shoulder portion on said nozzle.

10. A projectile release mechanism for facilitating launching a jet-propelled projectile, comprising:

a nozzle extending from said projectile, including fusible joint means for heating by high-temperature exhaust gases expelled by said projectile to release the projectile;

a projectile support means, including receptacle means generally coaxial with said nozzle by receiving the nozzle and thereby supporting said projectile;

means for retaining the nozzle in said receptacle means and permitting a fore section of said nozzle to move out of said receptacle means on fusing and separation of said fusible joint means; and biasing means operatively associated with said nozzle and effective to maintain the fore section of said nozzle in said receptacle means until complete separation of said fusible joint means, thereby accommodating any thermal expansion of the nozzle.

11. The projectile release mechanism of claim 10 wherein said biasing means comprises a plurality of spring members equally spaced about and concentric with the axis of said nozzle.

12. The projectile release mechanism of claim 10 wherein said retaining means includes a forwardly facing shoulder portion on said support means forward of said fusible joint means, and a complementarily engageable shoulder portion on said nozzle, said biasing means being effective to maintain said shoulder portions in engagement until complete separation of said fusible joint means.

13. The projectile release mechanism of claim 12 wherein said biasing means comprises a plurality of spring members equally spaced about and concentric with the axis of said nozzle.

14. The projectile release mechanism of claim 12 wherein said forwardly facing shoulder portion on said support means is outwardly tapered relative to the axis of said nozzle and engageable with a complementarily inwardly tapered shoulder portion on said nozzle.

15. The projectile release mechanism of claim 12 wherein said forwardly facing shoulder portion on said support means comprises a forwardly opening conical section generally concentric with the axis of said nozzle and engageable with a complementary conical shoulder portion on said nozzle.

16. The projectile release mechanism of claim 15 wherein said biasing means comprises a plurality of spring members equally spaced about and concentric with the axis of said nozzle.

17. A release mechanism for facilitating mechanism for facilitating launching of a spin-stabilized spherical jet-propelled missile, comprising:

missile support means including rotary means and means for supporting said rotary means for rotation about a spin axis, said rotary means including receptacle means defining said spin axis;

a nozzle assembly on said missile, including a nozzle member extending between said missile and said support means for securing said missile to said support means, said nozzle member extending into and mating with said receptacle means;

separation means between said missile and said support means; and outwardly tapered shoulder means on said receptacle means forwardly of said separation means and engageable with complementarily tapered shoulder means on said nozzle member to insure proper alignment of said missile with said spin axis during initial separation of said separation means.

18. The release mechanism of claim 17 wherein said shoulder means on said receptacle means comprises a forwardly opening conical section generally concentric with the axis of said nozzle and engageable with a complementary conical shoulder means on said nozzle.

19. The release mechanism of claim 17 wherein said separation means comprises fusible joint means, and including biasing means operatively associated with said nozzle member and effective to maintain a fore section of said nozzle member, forward of said fusible joint means, in said receptacle means until complete separation of said fusible joint means, thereby accommodating any thermal expansion of the fusible joint means.

20. The release mechanism of claim 19 wherein said biasing means comprises a plurality of spring members equally spaced about and concentric with said axis.

21. The release mechanism of claim 19 wherein said shoulder means on said receptacle means comprises a forwardly opening conical section generally concentric with the axis of said nozzle and engageable with a complementary conical shoulder means on said nozzle.

22. The release mechanism of claim 21 wherein said biasing means comprises a plurality of spring members equally spaced about and concentric with said axis.

* * * * *

UNITED STATES PATENT AND TRADEMARK OFFICE

CERTIFICATE OF CORRECTION

PATENT NO. : 4,403,435

DATED : September 13, 1983

INVENTOR(S) : Alan C. Baker, Nathan N. Shiovitz and George E. Whiting

It is certified that error appears in the above—identified patent and that said Letters Patent is hereby corrected as shown below:

In The Claims:

Claim 17, line 1, delete "for facilitating mechanism".

Signed and Sealed this

*Sixth* Day of *December 1983*

[SEAL]

*Attest:*

GERALD J. MOSSINGHOFF

*Attesting Officer*

*Commissioner of Patents and Trademarks*